US010301892B2

(12) United States Patent
Castillo et al.

(10) Patent No.: US 10,301,892 B2
(45) Date of Patent: May 28, 2019

(54) WIRELINE PERFORMANCE PROFILE ANALYSIS

(71) Applicants: Homero Cesar Castillo, Humble, TX (US); Robert Brown, Sugar Land, TX (US)

(72) Inventors: Homero Cesar Castillo, Humble, TX (US); Robert Brown, Sugar Land, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 199 days.

(21) Appl. No.: 15/238,317

(22) Filed: Aug. 16, 2016

(65) Prior Publication Data

US 2018/0051540 A1 Feb. 22, 2018

(51) Int. Cl.
*E21B 19/22* (2006.01)
*E21B 47/00* (2012.01)

(52) U.S. Cl.
CPC ..... *E21B 19/22* (2013.01); *E21B 47/0006* (2013.01)

(58) Field of Classification Search
CPC .... E21B 19/008; E21B 41/0092; E21B 19/02; B66D 1/505; Y10S 254/90
See application file for complete search history.

(56) References Cited

U.S. PATENT DOCUMENTS 5,081,613 A 1/1992 Holzhausen et al.
5,353,877 A * 10/1994 DeCorps ..... E21B 23/02 166/373
6,216,789 B1 * 4/2001 Lorsignol ..... B66D 1/505 166/355
8,027,819 B2 9/2011 Yoshida et al.
8,977,523 B2 3/2015 Ertas et al.
9,038,740 B2 5/2015 Lende et al.
2005/0138830 A1 * 6/2005 Fitzgerald ..... E21B 47/04 33/773
2009/0255728 A1 * 10/2009 Spencer ..... E21B 7/124 175/5
2013/0124176 A1 5/2013 Fox et al.
(Continued)

OTHER PUBLICATIONS

Babin, et al.; "Cables and Skates—Improving the Weakest Links"; Oilfield Review, Winter 2014/2015; 26., No. 4; Schlumberger; 16 pages.

*Primary Examiner* — Elias Desta
(74) *Attorney, Agent, or Firm* — Cantor Colburn LLP

(57) ABSTRACT

A method for operating a wireline winch configured to convey a wireline coupled to a downhole tool disposed in a borehole penetrating the earth includes: receiving a first cumulative surface wireline tension limit for downhole wireline components; calculating a second cumulative surface wireline tension limit for surface components using wireline speed and surface equipment data; combining the first and the second cumulative surface wireline tension limits to provide a total cumulative surface wireline tension limit as a function of depth; presenting the total cumulative surface wireline tension limit as a function of depth and operating wireline tension values as a function of depth for the downhole tool to a user; performing an assessment of the operating wireline tension values as a function of depth versus the total cumulative surface wireline tension limit as a function of depth; and operating the wireline winch using the assessment and a winch controller.

26 Claims, 10 Drawing Sheets

(56) References Cited

U.S. PATENT DOCUMENTS

| | | | | |
|---|---|---|---|---|
| 2014/0174726 | A1 | 6/2014 | Harringan et al. | |
| 2015/0090498 | A1 | 4/2015 | Hareland | |
| 2016/0215579 | A1* | 7/2016 | Van Der Ende ..... | E21B 23/14 |

* cited by examiner

WIRELINE PERFORMANCE PROFILE ANALYSIS

BACKGROUND

Earth formations may be used for various purposes such as hydrocarbon production, geothermal production and carbon dioxide sequestration. In order to efficiently use the formations, measurements are typically performed on the formations using sensors or tools disposed in boreholes penetrating the formations, and a variety of well interventions are required and performed to initiate and maintain production rates. The instrumentation required to perform these measurements and interventions are here referred as downhole tools. Common conveyance methods used to deploy downhole tools use electro-mechanical cables, referred as wirelines or armor wirelines; other variations include slick line cables, braided lines, semi-rigid rods, and the like.

When wirelines are used to perform downhole measurement operations, these operations are referred to as wireline logging. The wireline physically supports and conveys the tool and also contains electrical conductors for supplying power to the tool and communicating sensed data with a processor at the surface.

A wireline operator at the surface near the entrance to the borehole typically operates a winch that can deploy and retrieve the wireline. A goal of the operator is to operate the winch in a manner that would prevent damage to the wireline or breaking the wireline. Hence, it would be well received in the drilling industry if methods and apparatuses were developed to provide wireline operators with sufficient wireline data to help prevent damage to or breaking of wirelines.

The ability to drill wells with extreme lengths and complex trajectories has resulted on significant challenges when assessing the feasibility of wireline operations in these wells as well as when planning and executing them. It is a common practice today to use forces-simulation software to perform simulations to optimize the conveyance aspects of these wireline operations; they usually determine the maximum tension that can be safely pulled at all depths under different conditions, such as running in, pulling out inside the casing or in the openhole.

Current simulations use, as working limits, the following mechanical properties of the wireline type selected and the cablehead weakpoint planned for the given job: wireline working limit, wireline weight, weakpoint low and high break ratings. That is, the current simulations are based on performance properties of downhole equipment and the downhole environment including the geometry of the borehole and formation properties.

BRIEF SUMMARY

Disclosed is a method for operating a wireline winch configured to convey a wireline coupled to a downhole tool disposed in a borehole penetrating the earth. The method includes: receiving with a processor a first cumulative surface wireline tension limit as a function of depth for downhole wireline components comprising the downhole tool, a cable head weakpoint coupled to the downhole tool, and the wireline up to a specified point along the wireline; inputting into the processor (i) a wireline speed as a function of depth and (ii) surface equipment data related to rig-up equipment comprising a wireline winch, a wireline winch drum, an optional capstan, and the wireline from the specified point to the wireline winch; calculating with the processor a second cumulative surface wireline tension limit as a function of depth using the wireline speed and the surface equipment data; combining the first cumulative surface wireline tension limit as a function of depth with the second cumulative surface wireline tension limit as a function of depth to provide a total cumulative surface wireline tension limit as a function of depth that takes into account downhole wireline components and surface wireline components; presenting with the processor the total cumulative surface wireline tension limit as a function of depth and operating wireline tension values as a function of depth for the downhole tool conveyed through the borehole to a user; performing with the processor an assessment of the operating wireline tension values as a function of depth versus the total cumulative surface wireline tension limit as a function of depth; and operating the wireline winch using the assessment and a winch controller.

Also disclosed is a system for operating a wireline winch configured to convey a wireline coupled to a downhole tool disposed in a borehole penetrating the earth. The system includes: downhole wireline components comprising the downhole tool, a cable head weakpoint coupled to the downhole tool, and the wireline up to a specified point along the wireline; rig-up equipment comprising a wireline winch, a wireline winch drum, an optional capstan, and the wireline from the specified point to the wireline winch; and a processor. The processor is configured to: receive a first cumulative surface wireline tension limit as a function of depth for downhole wireline components comprising the downhole tool, a cable head weakpoint coupled to the downhole tool, and the wireline up to a specified point along the wireline; receive (i) a wireline speed as a function of depth and (ii) surface equipment data related to rig-up equipment comprising a wireline winch, a wireline winch drum, an optional capstan, and the wireline from the specified point to the wireline winch; calculate a second cumulative surface wireline tension limit as a function of depth using the wireline speed and the surface equipment data; combine the first cumulative surface wireline tension limit as a function of depth with the second cumulative surface wireline tension limit as a function of depth to provide a total cumulative surface wireline tension limit as a function of depth that takes into account downhole wireline components and surface wireline components; present the total cumulative surface wireline tension limit as a function of depth and operating wireline tension values as a function of depth for the downhole tool conveyed through the borehole to a user; and perform an assessment of the operating wireline tension values as a function of depth versus the total cumulative surface wireline tension limit as a function of depth. The system also includes a winch controller configured to control the wireline winch by an operator using the assessment.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
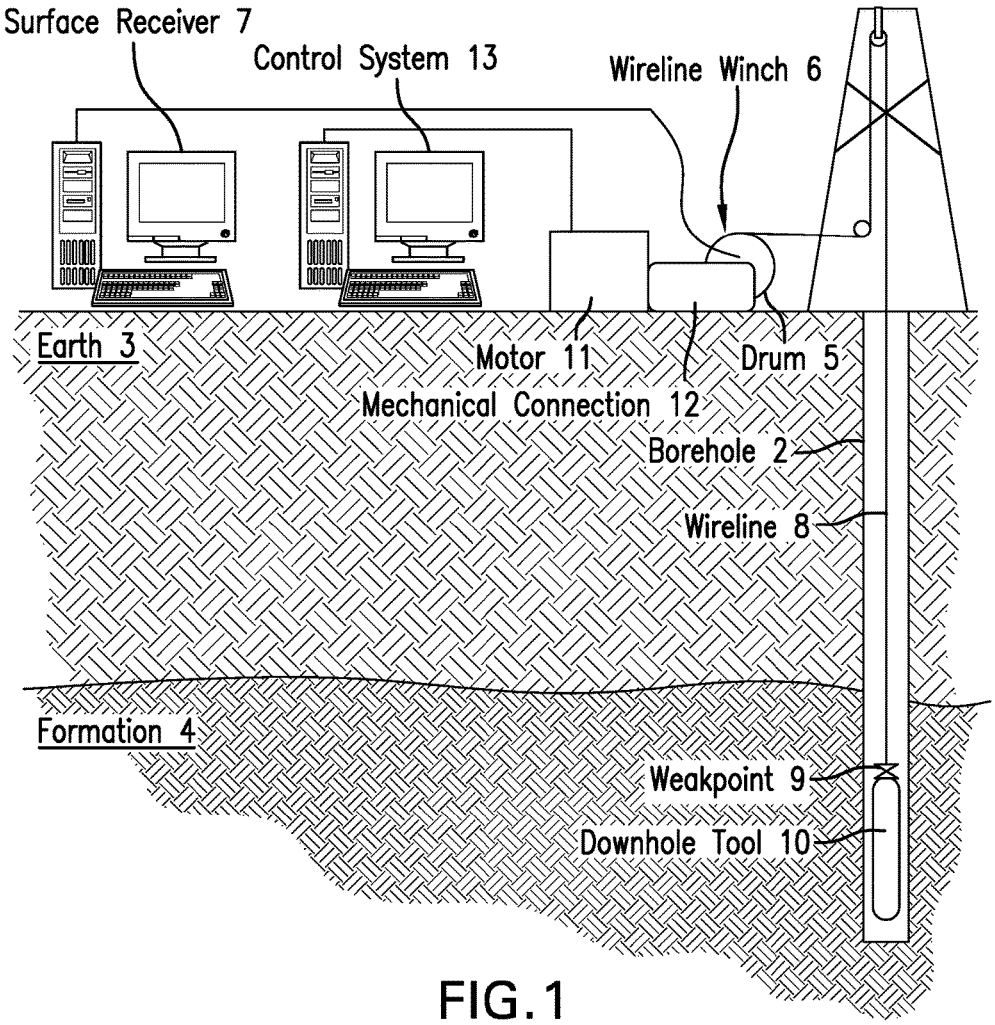
FIG. 1 is a cross-sectional view of a downhole wireline tool disposed in a borehole penetrating the earth.

A detailed description of one or more embodiments of the disclosed apparatus and method is presented herein by way of exemplification and not limitation with reference to the figures.

Although the content of this application uses wireline operations to provide the detail descriptions, the disclosure herein is equally applicable to operations performed using slick line, braided line and semi-rigid rods.

Disclosed are methods and apparatuses for operating a wireline winch configured to convey a wireline coupled to a downhole tool disposed in a borehole penetrating the earth. A first cumulative surface wireline tension limit as a function of depth for downhole wireline components is received by a processor. Wireline speed as a function of depth and surface equipment data for surface wireline components are input into the processor and the processor calculates a second cumulative surface wireline tension limit as function of depth due to the surface wireline components. The first and second cumulative surface wireline tension limits are combined to give a total cumulative surface wireline tension limit that is due to both downhole wireline components and surface wireline components. An assessment is performed using the total cumulative surface wireline tension limit and operating wireline tension values as a function of depth for a tool. The results of the assessment are provided to a user using an interface such as a display monitor or a print-out. The user, such as a winch operator, then operates the winch within the constraints provided by the assessment. By operating the winch within the constraints, the likelihood of damaging the wireline or breaking the wireline is reduced or eliminated.

During wireline operations the downhole tools weight pulls the wireline down into the borehole while the winch spools out wireline from the winch drum, and the downhole tools are retrieved to the surface by spooling in the wireline back on the winch drum; the condition in which the movement of the downhole tools is unrestricted is referred as "free tool." When the movement of the downhole tools is restricted or no longer possible this condition is referred as "stuck tool." Downhole tools can become stuck in the borehole because borehole wall material falls and accumulates on top of the downhole tools (a condition referred as buried tool), or a pressure lock produced by excessive differences between the hydrostatic pressure of the fluid column in the well and the in-situ pressure present in the formations (a condition referred as differentially stuck tool).

When designing a wireline job, forces-simulations are performed for both conditions, free and stuck tool. Wirelines have different working tension limits defined for "free tool" and "stuck tool" conditions.

When the forces-simulations indicate high tensions to be required to complete a wireline operation, a powered capstan is added to the surface configuration. Powered capstans are devices installed between the winch unit and the well, and the wireline is threaded through the capstan wheels. A common powered capstan design allows assisting the winch unit to achieve the required tensions on the well side while maintain the tension on the drum side to constant tension selected by the operator. When designing wireline jobs that include powered capstans the tension on the drum side is kept as close as possible to the original tension used when spooling the wireline on the drum prior to the job (generally a tension equivalent to 25% of the breaking strength of the wireline).

In wireline operations a key objective is to minimize the time required to complete such operations without compromising the operation or the quality of the data acquired or intervention planned. To achieve this, the speed at which the wireline and the downhole tools move is carefully selected. Higher speeds result in higher fluid resistance which translates to lower tensions while running in the hole and higher tensions while pulling out of the hole. The ability to pull tensions the winch unit and the powered capstan have is a function of the speed at which the wireline is moving, thus, this needs to be considered while designing the speed profile for a given operation.

This disclosure expands the functionality of the simulations performed with forces-modeling software to include the following additional factors: working limits of all rig-up equipment elements, reduced working limit of the wireline splices present in the actual wireline selected, actual wireline length, and location of the cables splices, geometry of the drum on which the wireline is spooled, performance of the actual winch unit and optional powered capstan selected, and cable speeds planned for each stage of the logging operation.

Some of the products of the simulations that include the factors listed above intended to guide the winch/capstan operator are: cumulative surface working tension limit curves for "Free Tool" and "Stuck Tool" conditions, optimized surface tension distribution between the winch and the powered capstan for "Free Tool" and "Stuck Tool" conditions, cumulative maximum over pull achievable curve for a stuck tool condition at all depths, optimized cable speed profile for the given operation, forecast of the cable spooling profile after the job and at all stages of the operation.

The methods disclosed herein may be used to help design efficient wireline operations where the selection of equipment, configuration and operation are optimized for the performance specifications of all the equipment involved. Data related to the well geometry/trajectory/fluid, wireline, winch, capstan, drum, rig up equipment and the downhole tool is entered into a processor. An algorithm executed by the processor calculates a cumulative surface wireline tension limit as a function of depth that accounts for all individual equipment performance, working limits, operational conditions and wireline speed. The resulting tension curves are provided to a user via an interface such as a display monitor or a print-out that includes a list of statements indicating the outcome of an assessment of the operating tension values against the cumulative surface tension limit calculated to help optimize the job design.

FIG. 1 is a cross-sectional view of one embodiment of a downhole wireline tool 10 disposed in a borehole 2 penetrating the earth 3. The earth 3 includes an earth formation 4, which can represent any subsurface materials of interest. The downhole tool 10 is configured to perform measurements or operations on the borehole 2 and/or the formation 4. A wireline 8 is coupled to a cablehead weakpoint 9 on the downhole tool 10. The wireline 8 represents and is inclusive of any carrier such as a slick line, a braided line, semi-rigid rods or any carrier component, which can be wound upon a winch drum. The weakpoint 9 is configured to break at a known tension or within a known range of tensions depending on the ambient temperature. The wireline 8 is configured to support and convey the downhole tool 10 in the borehole 2. The wireline 8 includes electrical conductors (not shown) configured to supply electrical power to the downhole tool 10 and provides communications with the downhole tool 10. Communications may include transmitting sensed data to a surface receiver 7, which may be a computer processing system, or sending commands to the downhole tool 10 from a surface controller such as the surface computer processing system.

Still referring to FIG. 1, a wireline winch 6 is configured to deploy (i.e., unreel) the wireline 8 into borehole 2 and retrieve (i.e., reel-in) the wireline 8 from the borehole 2. The winch 6 includes a drum 5 onto which the wireline 8 is wound. As the wireline 8 is wound around the drum 5, layers of the wireline 8 are disposed on the drum based on the dimensions of the drum 5. A motor 11 is configured to rotate the drum 5 via a mechanical connection 12, which may include a gear set that provides for a desired final drive or gear reduction ratio. Non-limiting embodiments of the motor 11 include an electric motor, an internal combustion motor, and a hydraulic motor powered by a hydraulic pump. A control system 13 is configured to control operation of the winch 6. The control system 13 is further configured to accept manual control inputs from a winch operator and/or to automatically control operation based on a selected control algorithm.

Figure 2:
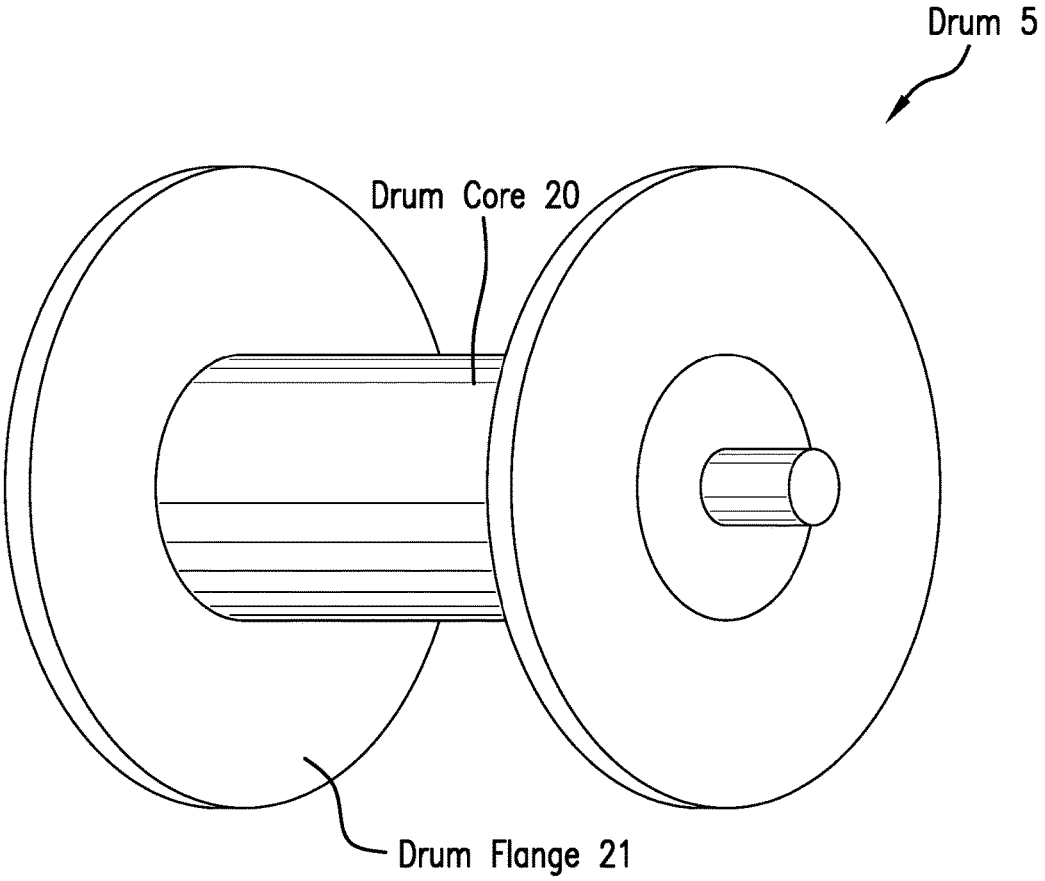
FIG. 2 depicts aspects of a winch drum for deploying and retrieving a wireline.

FIG. 2 depicts aspects of components of the drum 5 of the wireline winch 6. The drum 5 includes a drum core 20 and a drum flange 21. In one embodiment, the width of the drum core is 49.5 inches and the diameter of the drum core is 24 inches. In an alternative embodiment, the width of the drum core is 34.125 inches and the diameter of the drum core is 20.5 inches.

Figure 3:
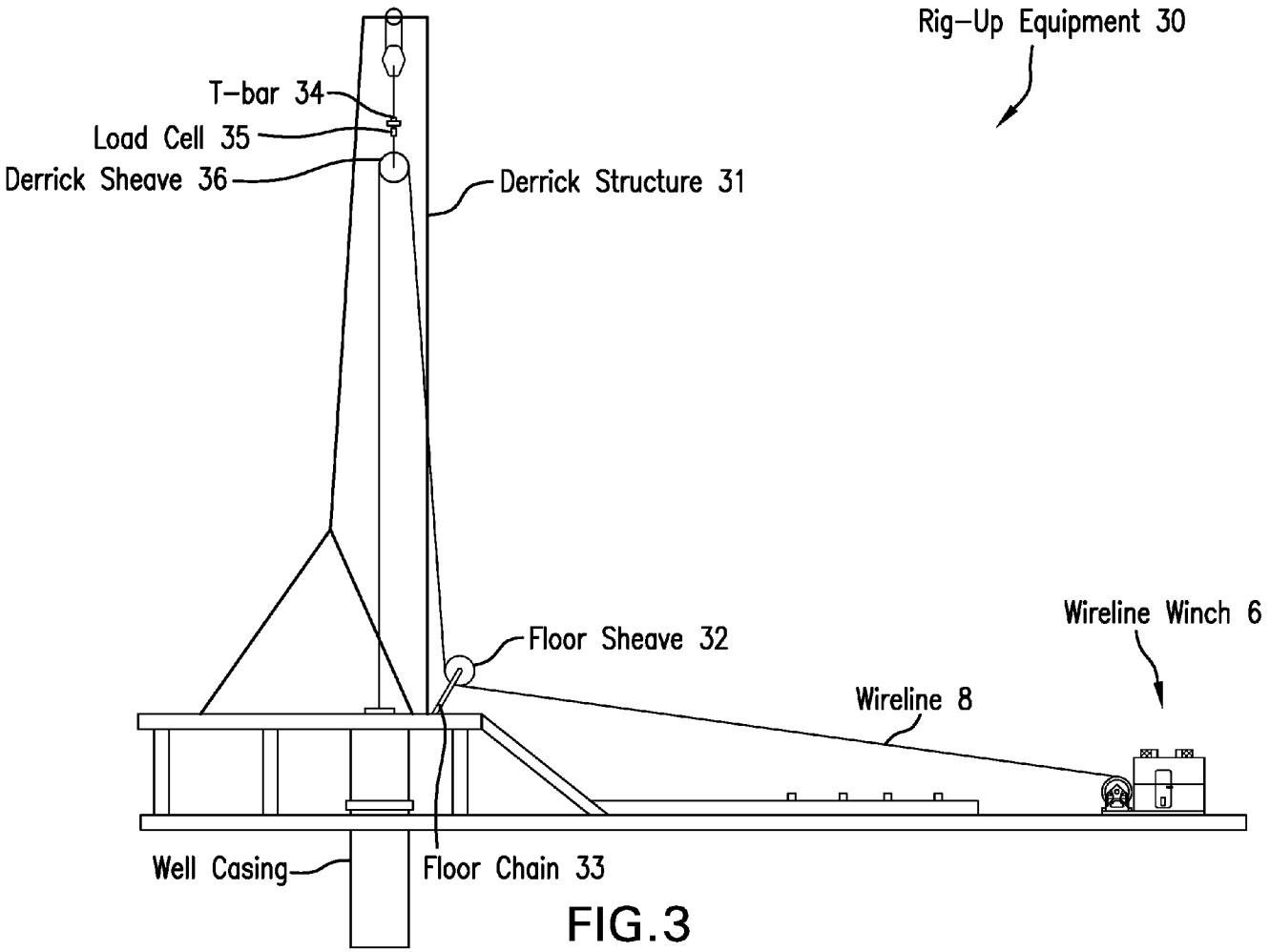
FIG. 3 depicts aspects of rig-up equipment coupled to a derrick structure.

FIG. 3 depicts aspects of rig-up equipment 30 coupled to a derrick structure 31. Non-limiting embodiments of the rig equipment 30 include a floor sheave 32 coupled to a floor chain 33, a T-bar 34 coupled to elevators and/or elevator bales, a load cell 35, and a derrick sheave 36 coupled to the load cell 35. The load cell 35 provides a load measurement on the wireline 8. An indication of the measured load may be provided to a winch operator via a display of the control system 13. Associated with each component of the rig-up equipment is a maximum operating load limit, which may be used for calculating the cumulative surface wireline tension limit.

Figure 4:
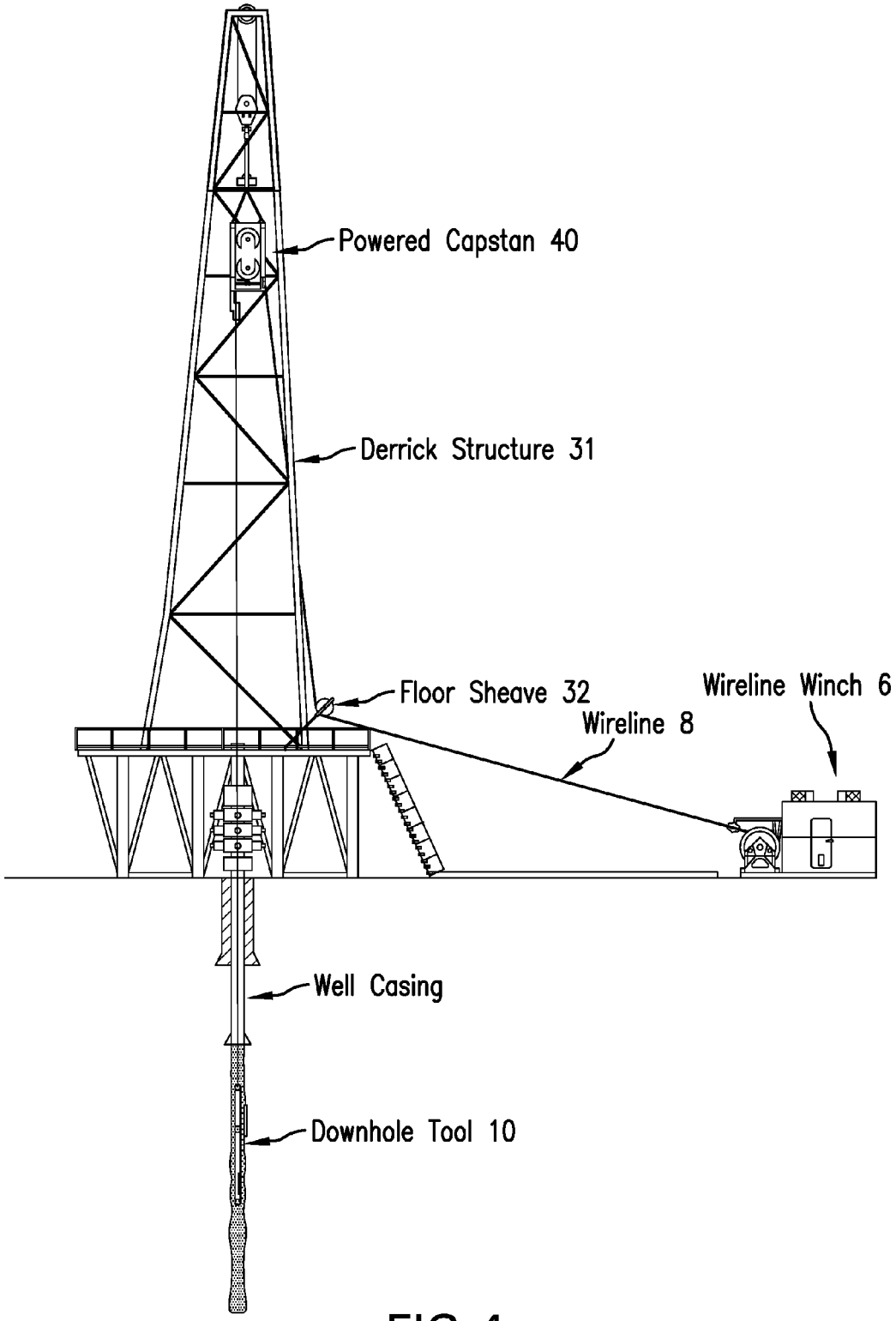
FIG. 4 depicts aspects of the rig-up equipment with a powered capstan suspended from the derrick structure.
Figure 5:
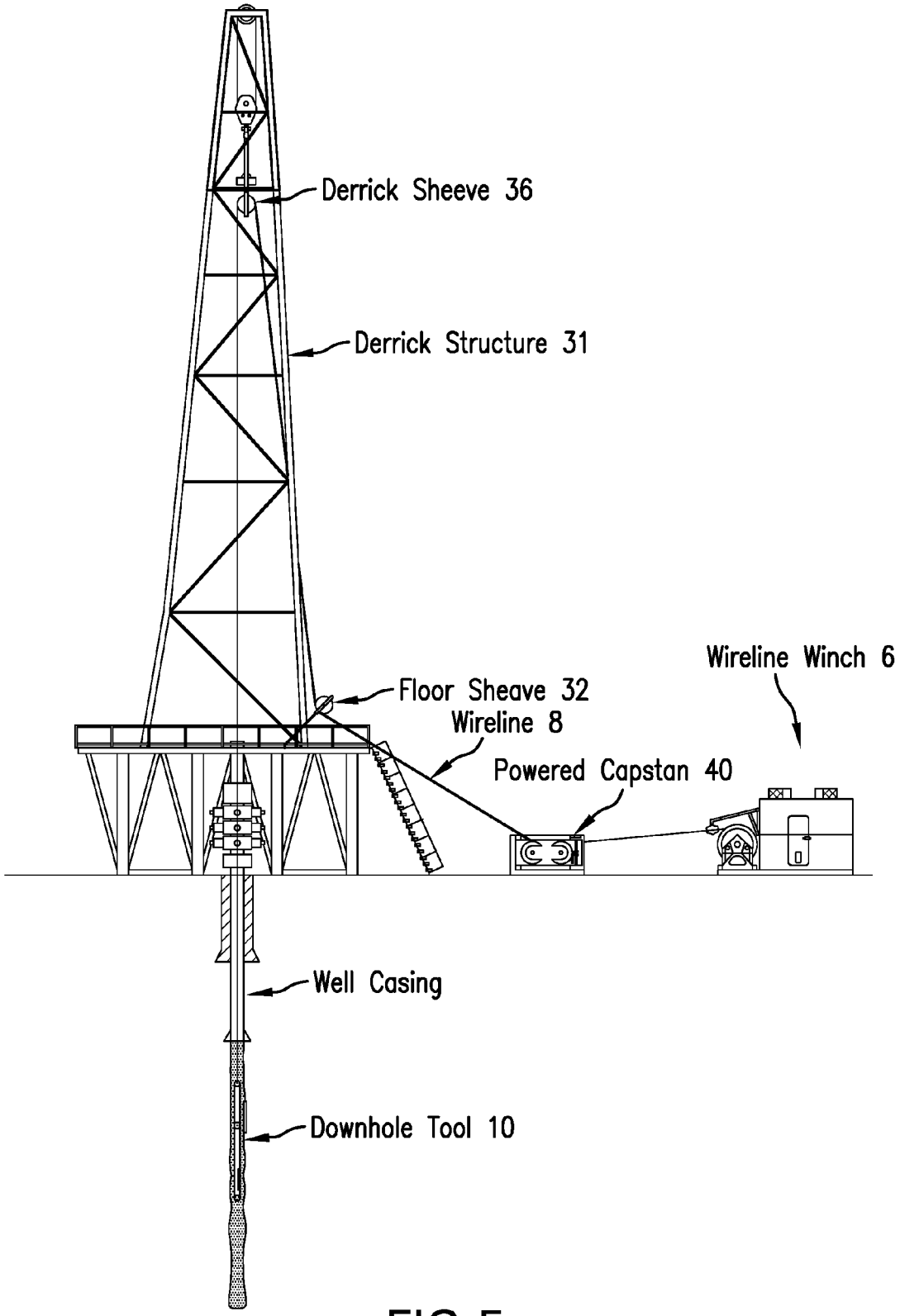
FIG. 5 depicts aspects of the rig-up equipment in another embodiment with the powered capstan not suspended from the derrick structure.

FIG. 4 depicts aspects of the rig-up equipment 30 with a powered capstan 40 suspended from the derrick structure 31. The powered capstan 40 is used to maintain a constant "adjustable" wireline tension as it is spooled on the drum (referred as drum tension) regardless of the well tension (defined as the wireline tension on the well side of the capstan). The purpose of this device is to keep a constant drum tension by generating a tension differential between the well tension and the drum tension. The powered capstan automatically maintains the winch drum at a screen selected "target" tension with the cable running in either direction. While running out of the hole under high tension, the capstan reduces the tension between it and the drum. Conversely, while running into a deviated hole where the tension is lower due to drag, the capstan increases tension between it and the drum. By doing so, in both cases, the correct tension profile is maintained, within certain limits. For example, while running out of the hole with 22,000 pounds of well tension using a capstan capable of pulling up to 18,000 pounds, the drum tension may be reduced to 4,000 pounds. Conversely, while running in the hole with a well tension of 2,000 pounds the capstan is able to increase the tension between it and the drum to achieve the 4,000 pounds drum tension target. FIG. 5 depicts aspects of the rig-up equipment 30 in another embodiment with the powered capstan 40 not suspended from the derrick structure, but disposed on the ground or platform.

Figure 6:
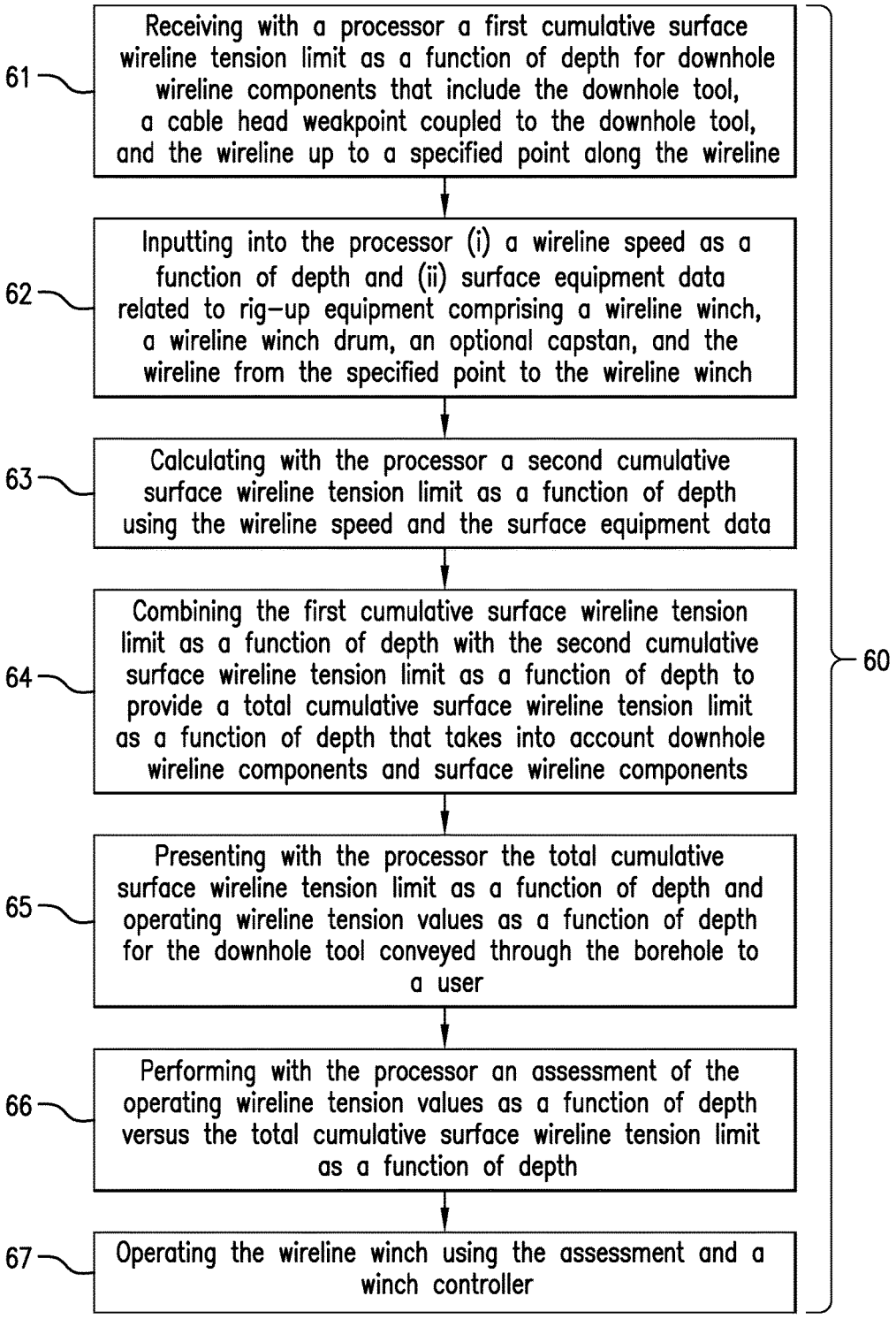
FIG. 6 presents a flow chart for a method 60 for operating a wireline winch configured to convey a wireline coupled to a downhole tool disposed in a borehole penetrating the earth.

FIG. 6 presents a flow chart for a method 60 for operating a wireline winch configured to convey a wireline coupled to a downhole tool disposed in a borehole penetrating the earth. Block 61 calls for receiving with a processor a first cumulative surface wireline tension limit as a function of depth for downhole wireline components that include the downhole tool, a cable head weakpoint coupled to the downhole tool, and the wireline up to a specified point along the wireline. In one or more embodiments, the specified point may be at the first operational component contacted by the wireline at the surface such as a sheave for example. Some or all received data may be stored in the form of a look-up table stored in a non-transitory computer-readable medium. Alternatively or in addition, some or all received data not stored in a look-up table may be input individually on an as-needed basis. In general, the first cumulative surface wireline tension limit as a function of depth accounts for geometry and trajectory of the borehole, dimensions and weight of the downhole tool, properties of a borehole fluid, friction between the downhole tool and a wall of the borehole, and resistance to movement of the downhole tool by the borehole fluid. In one or more embodiments, the friction between the downhole tool and a wall of the borehole, the resistance to movement of the downhole tool by the borehole fluid, and the tension on the wireline due to the weight of the downhole tool may be calculated using finite element analysis as known in the art.

Block 62 calls for inputting into the processor (i) a wireline speed as a function of depth and (ii) surface equipment data related to rig-up equipment having a wireline winch, a wireline winch drum, an optional capstan, and the wireline from the specified point to the wireline winch. Some or all inputted data may be stored in the form of a look-up table stored in a non-transitory computer-readable medium. Alternatively or in addition, some or all inputted data not stored in a look-up table may be input individually on an as-needed basis. The wireline speed as a function of depth may be obtained from a logging plan. In one or more embodiments, the rig-up equipment further include a floor chain, a floor sheave coupled to the floor chain, a T-bar, a derrick sheave, and a load cell coupled to the derrick sheave. In one or more embodiments, the surface equipment data may include a maximum operating load for each component of the rig-up equipment and the wireline from the specified point to the wireline winch.

Figure 7:
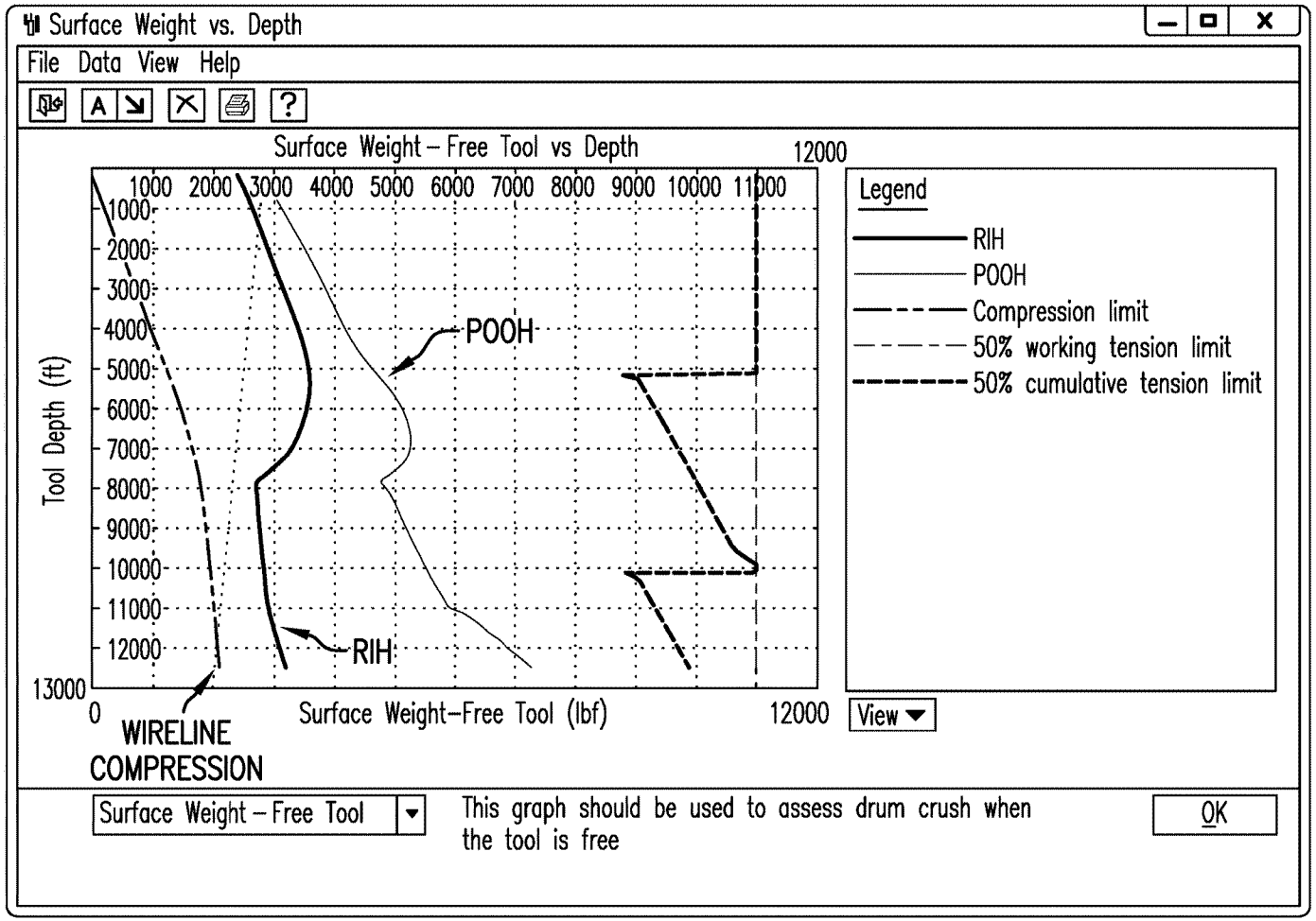
FIG. 7 depicts aspects of the surface wireline tension limit of a wireline with no splices and the surface wireline tension limit of a wireline with two splices for a free tool.
Figure 8:
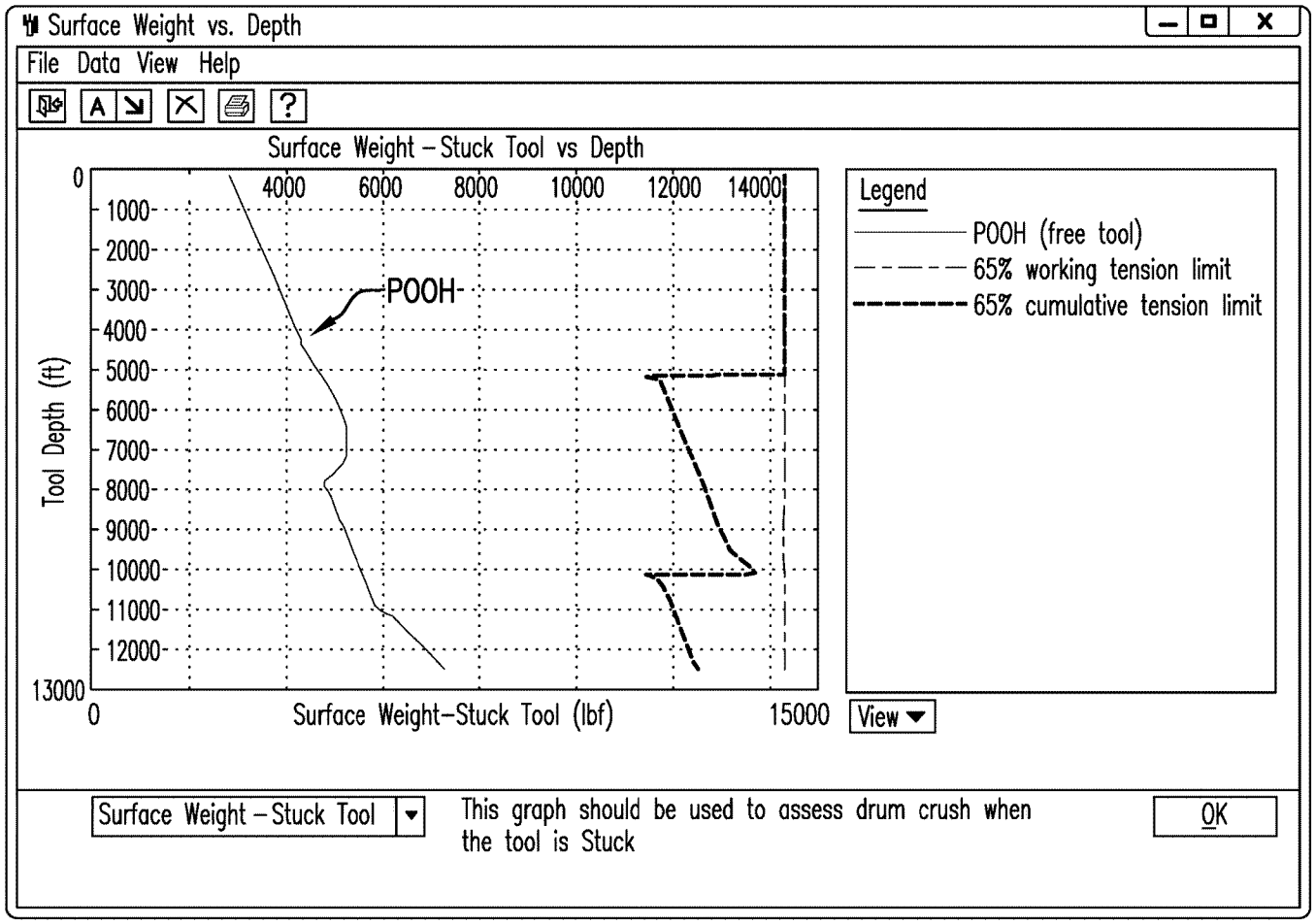
FIG. 8 depicts aspects of the surface wireline tension limit of a wireline with no splices and the surface wireline tension limit of a wireline with two splices for a stuck tool.

Block 63 calls for calculating with the processor a second cumulative surface wireline tension limit as a function of depth using the wireline speed and the surface equipment data. In one or more embodiments, the wireline includes one or more splices and the second cumulative surface wireline tension limit as a function of depth for the wireline having one or more splices accounts for tension degradation due to each splice and for the wireline being reeled on the wireline winch drum such that when each splice is reeled in on the wireline winch drum, the second cumulative surface wireline tension limit as a function of depth is not degraded for that reeled in splice. The reduction in tension limit due to each splice and the location of each splice in the wireline are input into the processor. The reduction in tension limit can be determined or estimated by analysis and/or testing for the type of splice used. In one or more embodiments, a 20% reduction in the tension limit is used for each splice. FIG. 7 depicts aspects of the surface wireline tension limit of a wireline with no splices (see vertical line at right) and the surface wireline tension limit of a wireline with two splices (see dashed saw-tooth line superimposed over part of the vertical line, one splice at 10,000 feet from the drum core and the second splice at 15,000 feet from the drum core) for a free tool. The surface wireline tension limit of a wireline with no splices is generally set to be a percentage, such as 50%, of the breaking tension of the wireline. In FIG. 7, RIH relates to run-in-hole, POOH relates to pull-out-of-hole, and WIRELINE COMPRESSION relates to the loss of tension the wireline may be subjected to without experiencing damage. Similarly, FIG. 8 depicts aspects of the surface wireline tension limit of a wireline with no splices and with two splices for a stuck tool. Note that the tension limits are increased for the stuck tool. In one or more embodiments, calculating a second cumulative surface wireline tension limit as a function of depth includes calculating a surface wireline tension limit due to the wireline being wound on the wireline winch drum at the wireline speed. In one or more embodiments, calculating a second cumulative surface wireline tension limit as a function of depth includes determining a distribution of wireline tensions due to the optional powered capstan.

Block 64 in FIG. 6 calls for combining the first cumulative surface wireline tension limit as a function of depth with the second cumulative surface wireline tension limit as a function of depth to provide a total cumulative surface wireline tension limit as a function of depth that takes into account downhole wireline components and surface wireline components. In one or more embodiments, combining includes using a most limiting surface wireline tension for each borehole depth or range of borehole depths from each of the surface tension limits determined for the downhole components and the surface wireline components. For example, for downhole and surface components the most limiting wireline tension limit is selected from all the wireline tension limits for the components as the total cumulative surface wireline tension limit. That is, in one or more embodiments, the cumulative surface wireline tension limit is the most limiting of all the surface tension limits in a chain of wireline components.

Figure 9:
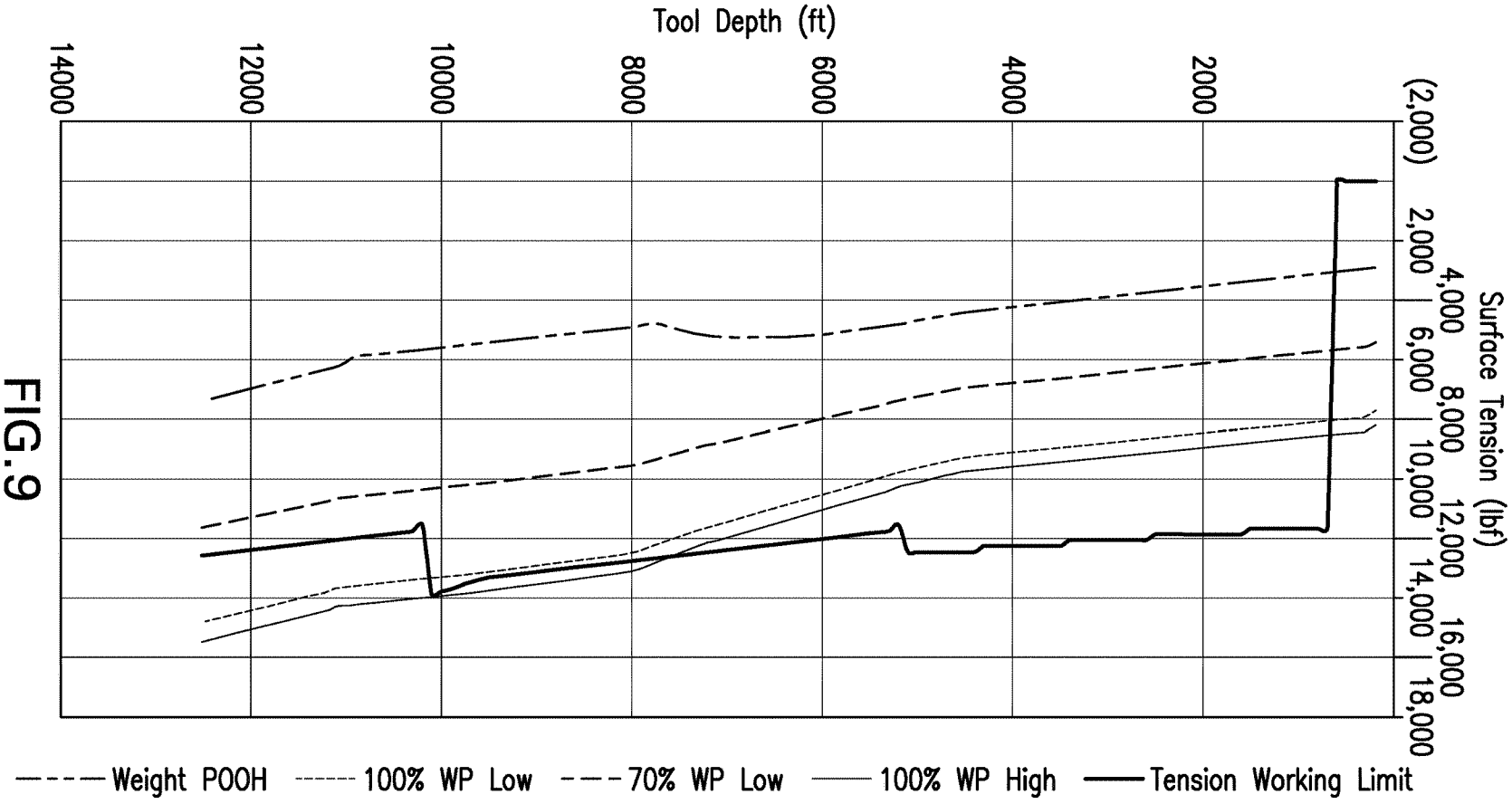
FIG. 9 illustrates a graphical representation of the total cumulative surface wireline tension limit as a function of depth and operating wireline tension values as a function of depth for a free tool.

Block 65 calls for presenting with the processor the total cumulative surface wireline tension limit as a function of depth and operating wireline tension values as a function of depth for the downhole tool conveyed through the borehole to a user. The downhole tool may be a free tool or a stuck tool. Operating wireline tension values are those values obtained from simulating a planned wireline operation. That is, the forces imposed on the wireline and downhole tool for the planned wireline operation are simulated and the resulting surface wireline tension values are calculated. The simulation may be performed using finite element analysis for example as discussed above in block 61. The simulation may take into account forces imposed by surface equipment as well forces imposed on downhole components such as by the environment. Accordingly, the method 60 may include simulating on a processor a planned wireline operation to provide the operating wireline tension values. In one or more embodiments, presenting includes providing curves illustrating the total cumulative surface wireline tension limit as a function of depth and the operating wireline tension values as a function of depth. FIG. 9 illustrates a graphical representation of the total cumulative surface wireline tension limit as a function of depth and operating wireline tension values as a function of depth for a free tool. In the embodiment of FIG. 9, the wireline used on the analysis has two splices—one splice at just over 5000 feet and another splice at just over 10,000 feet. Note that the small discontinuities above approximately 5,000 feet are the result of the wireline being wrapped around the drum and forming a complete layer on the drum, thus extending the lever arm of the wireline coming onto or off of the drum (i.e., distance from the center of the drum to the point where the wireline comes onto the drum). Various tension limits due to the weakpoint are also presented. In a "stuck tool" condition, while attempting to pull the stuck tool free, the required wireline tensions exceed those expected for a free tool condition, and the corresponding total cumulative surface wireline tension limit as a function of depth is higher than the one computed for a free tool condition.

Block 66 in FIG. 6 calls for performing with the processor an assessment of the operating wireline tension values as a function of depth versus the total cumulative surface wireline tension limit as a function of depth. In one or more embodiments, performing an assessment of the operating wireline tension values as a function of depth versus the total cumulative surface wireline tension limit as a function of depth includes: (1) calculating a difference between the operating wireline tension values as a function of depth and the total cumulative surface wireline tension limit as a function of depth for each depth or range of depths; and (2) determining if the difference is at, above or below a threshold value. In one or more embodiments, the threshold value includes a first threshold value, a second threshold value less than the first threshold value, and a third threshold value less than the second threshold value such that (i) operation of the wireline winch with the difference at or above the first threshold value signifies "the result falls within a desired range," (ii) operation of the wireline winch with the difference between the first threshold value and the second threshold value signifies "the result is marginal or calls for special attention," and (iii) operation of the wireline winch with the difference less than the third threshold value signifies "the result indicates conditions that will probably prevent the wireline job from being completed." In one or more embodiments, the assessment may be may be presented using a user interface such as a display monitor or on a paper that is printed using a printer. Output to the user interface is generally via a processor system output port. In one or more embodiments, the assessment may be in the form of a list of statements for each depth or range of depths with a color code where green signifies "the result falls within a desired range," yellow signifies "the result is marginal or calls for special attention," and red signifies "the result indicates conditions that will probably prevent the wireline job from being completed." Further clarifying explanations mat be presented with each color code.

Block 67 calls for operating the wireline winch using the assessment and a winch controller. That is, the wireline winch may be operated by a user via a winch controller and using the assessment as a guide. Further, the operator may observe measurements performed by the load cell sensor to insure that the total cumulative surface wireline tension limit for each depth or range of depths is not exceeded.

Definitions and equations related to the calculations discussed above in block 63 are now discussed. Hydraulically driven winches utilize a closed loop hydraulic system to provide power to the winch instead of an engine-driven drive shaft and chain and sprocket system. As with the mechanically driven winch, the primary power source is either an internal combustion engine or electric motor. This is where the similarity ends. Instead of coupling the output mechanically to a driveshaft, the primary power source is fitted with a hydraulic pump. The pump provides a flow of hydraulic fluid of sufficient volume and pressure to turn the wireline drum. The fluid flows, via hydraulic hoses, to the hydraulic motor which provides power to the winch. There are two methods used to transfer power from the motor to the winch. The first is the standard chain and sprocket configuration; however the hydraulic motor is coupled to a reduction gearbox which in turn provides power to the drive sprocket. The second method is a "direct drive system". In this case, a different style drum is required which allows a gearbox and motor combination to be coupled directly to the drum. One end of the gearbox sits inside of the drum core and the other end, fitted with the hydraulic motor, is kept stationary by bolting it to a the structure that supports this side of the drum. As fluid flows to the motor it turns the gearbox, which in turn rotates the drum.

To calculate the hoist performance, the following values are obtained when they are "available" or calculated when not:

| | | |
|---|---|---|
| $L_{cd}$ | Length of Cable on the Drum (ft.) | $L_c - L_{ch}$ |
| $H_f$ | Flange Height (in) | $n * \frac{D_c}{2} * \tan\left(\frac{\pi}{3}\right)$ |
| $R_w$ | Winding radius (in) | $(D_b/2) + H_f$ |
| $L_{cd}$ | Cable on Drum for current layer | $2\pi \times \frac{R_w}{12} \times \frac{F_w}{D_c}$ |
| $T_l$ | Line Tension (lbf) | $(W_t + L_{ch}) \times (W_c + W_{cd})$ |
| $T_d$ | Drum Torque (ft-lb) | $T_l \times \frac{R_w}{12}$ |
| $T_{l,max}$ | Maximum Line Pull (lbf) | $\left(\frac{M_{max} \times P_{max}}{2\pi \times R_w}\right) \times G \times f_m$ |
| $L_{s,min}$ | Minimum Line Speed (fpm) | $S_{min} \times \frac{1}{G} \times \frac{2\pi}{12} \times R_w$ |
| $L_{s,max}$ | Maximum Line Speed (fpm) | $S_{max} \times \frac{1}{G} \times \frac{2\pi}{12} \times R_w$ |
| $P_h$ | Hydrostatic Pressure @Maximum Speed (psi) | $\left(\frac{2\pi \times T_d}{M_{min}}\right) \times \left(\frac{1}{G \times f_m}\right)$ |
| $P_{max,out}$ | Maximum Required Power (hp) | $\left(\frac{Q \times p_{max}}{1{,}714}\right) \times f_v \times f_m$ |
| $P_{req}$ | Required Power (hp) | $\frac{T_l - L_{s,max}}{33{,}000}$ |
| $P_{av}$ | Available Power (hp) | $P_e \times f_v \times f_m$ |
| $D_b$ | Drum Barrel (Core) Diameter (in) | |

-continued

| | |
|---|---|
| $D_c$ | Cable Diameter (in) |
| $W_f$ | Flange Width (in) |
| $f_m$ | Total Mechanical Efficiency |
| $f_v$ | Total Volumetric Efficiency |
| G | Total Gear Reduction Ratio |
| $L_c$ | Total Cable Length (ft) |
| $L_{ch}$ | Length of Cable in hole/depth (ft) |
| $M_{max}$ | Motor Maximum Displacement (cir) |
| $M_{min}$ | Motor Minimum Displacement (cir) |
| $P_e$ | Net Available Engine Power (hp) |
| $p_{max}$ | Net Maximum System Pressure (psi) |
| $V_g$ | Pump Maximum Displacement (cir) |
| Q | Pump Flow Rate (gpm) |
| $n_{max}$ | Motor Maximum Speed (rpm) |
| $n_{min}$ | Motor Minium Speed (rpm) |
| $W_c$ | Cable Weight (lb/Kft in $H_2O$) |
| $W_d$ | Estimated Drag (lb/ft) |
| $W_T$ | Tool String Weight (lb) |
| cir | Cubic inches per revolution |
| gpm | Gallons per minute |
| fpm | Feet per minute |

Wireline Unit Performance Equations are now discussed. Note that some of the following equations present "single point snap-shots" such as winding radius, wireline length for a particular layer, wireline depth, distance to flange, etc. These equations may be used to provide a complete winch performance profile by varying certain variables in the equations.

Winding Radius—The winding radius ($R_w$) is the distance from the center of the core for any particular layer of wireline wound on the drum. Specific numbers are provided for teaching purposes.

$R_{wL_1}$ Winding radius for the first layer $D_b$ 20.5 in.

$D_c$ 0.521 in.

$$R_{wL_1} = \left(\frac{D_b}{2}\right) + D_c = \left(\frac{20.5}{2}\right) + 0.521 = 10.25 + 0.521 = 10.77 \text{ in.}$$

Figure 10:
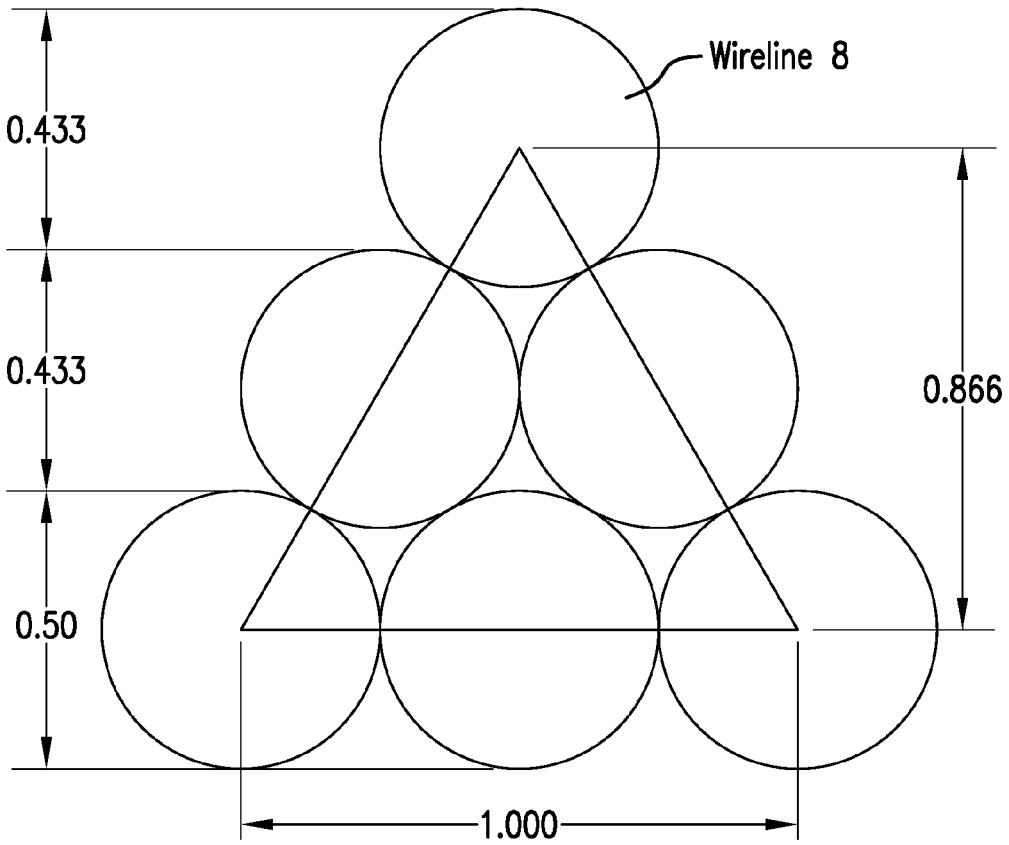
FIG. 10 illustrates an example of wireline packing on the winch drum.

Assuming an ideal situation where the wireline packing forms a 60° triangle as illustrated in FIG. 10 using non-limiting example dimensions, the effective cable diameter for subsequent layers, equal to sin 60°×0.521=0.866×0.521=0.433 in.

For layer no. 2:

$$R_{wL_{2,(2+1),(2+3),\ldots}} = 10.75 + 0.433 = 11.22 \text{ in.}$$

This continues until $$R_w = \frac{D_f}{2}$$

assuming a full drum of wireline.

$$\text{Distance to Flange} = \left(\frac{\text{Drum Diameter}}{2}\right) - R_{wL_1} = (27 - 10.75) = 16.25 \text{ in.}$$

Wireline length per layer is now calculated in one example using example values for teaching purposes.

$D_b$ 20.5 in.

$D_c$ 0.521 in.

$W_f$ 34.125 in.

$H_f$ 54 in.

$$L_1 = 2\pi \times \frac{R_w}{12} \times \frac{F_w}{D_c} = 6.283 \times \left(\frac{10.75}{12}\right) \times \left(\frac{34.125}{20.5}\right) = 6.283 \times 0.896 \times 1.665 = 384 \text{ ft.}$$

$L_n$—The wireline layer number relative to the wireline core.

$L_{layer}$=wireline length for any particular layer $L_n$=5

$L_{layer}$=((15.469×$L_n$))+367.3)=((15.469×5)+367.3)

$L_{layer}$=445 ft.

Length of Wireline on Drum is now calculated.

$$\text{Wireline on Drum} = \sum_{L_0}^{L_{(n-1)}} \left(\frac{\text{Length}}{\text{Layer}}\right)$$

Wireline Depth (i.e., Length of Wireline in Hole) is now calculated.

Depth=Total Wireline Length−Wireline Length on Drum

This is a critical value because, when multiplied by the drum speed (rpm), it gives the line speed or any particular layer and rotational speed. This is considered the maximum theoretical speed and does address the case where:

$$P_{av} < \frac{(L_{smax} \times 33{,}000)}{T_{lmax}}$$

This is the point where the winch cannot provide enough power to exceed the combination of line tension and speed. Either variable may be reduced, in order to keep the right side of the equation less than the maximum available power ($P_{av}$).

$$Ds_{rpm} = \frac{(S_{max,rpm})}{G} = \frac{5{,}000}{109} = 46.8\ rpm$$

Tool and Wireline Weight are now calculated.

$$\text{Tool and Line Weight} = \left(\left(\frac{\text{Depth (ft)}}{1{,}000}\right) \times \text{Line Weight in fluid}\right) + \text{Tool Weight}$$

Tension at Maximum Speed is now calculated using example values for teaching purposes.

$$\text{Maximum Tension} = \text{Motor Torque} \times \left(\frac{\text{Winding Radius (in)}}{12}\right) \times \text{Final Drive Ratio}$$

-continued $$\text{Maximum Tension} = 270 \text{ lb-ft} \times \left(\frac{12}{10.75}\right) \times = 270 \times 0.896 \times 97 = 29{,}235 \text{ lbf}$$

$$\text{Maximum Tension@Maximum Speed} = \frac{(\text{Available } Hyd \text{ hp} \times 33{,}000)}{\text{Max Speed}}$$

$$\text{Maximum Tension@Maximum Speed} = \frac{(128 \times 33{,}000)}{290} = 14{,}565 \text{ lbf}$$

Net Available Mechanical Power (hp) is now calculated using example values for teaching purposes. The net available engine power ($P_e$) is the total engine horsepower minus the power requirements for any associated hydraulically component such as the radiator cooling fan, electric generator, and any other auxiliary systems. This is the power available to feed the main hoist system pump. In general, this is valid for only skid units. The power at a truck's power take off (PTO) represents the net mechanical power.

$P_m$— Gross engine power output (in this example, assume that the prime mover, whether it be a diesel or electric motor, provides 235 hp to the hydraulic pump)

$P_{fan}$— Engine radiator cooling fan (if hydraulically operated)

$P_{gen}$—Electrical Generator $P_{aux}$—Any other hydraulically operated systems $P_e$=($P_{pm}$−$P_{fan}$−$P_{gen}$−$P_{aux}$)=(235−40−40−10)

$P_e$=145 hp

Net Maximum System Pressure (psi) is now calculated using example values for teaching purposes. The net maximum hydraulic system pressure ($P_{net}$) is the gross maximum system pressure ($P_{max}$) less the system charge pressure ($P_{chg}$), generally on the order of 400 psi.

$P_{net}$—Net maximum System Pressure $P_{max}$—Gross maximum System Pressure $P_{chg}$— System Charge Pressure $P_{net}$=($P_{max}$−$P_{chg}$)=(5,000−400)=4,600 psi Net Available Hydraulic Power (hp) is now calculated using example values for teaching purposes. The net available horsepower at the drum ($P_{av}$), is defined by the following equation. These parameters take into account any reductions related to the mechanical and hydraulic systems which will affect the performance of the hoist.

| | |
|---|---|
| $f_m$ | Total Mechanical Efficiency (90%) |
| $f_v$ | Total Volumetric Efficiency (90%) |
| $P_{max\ rpm}$ | Maximum Pump Speed (rpm) |
| $P_{act\ rpm}$ | Actual Pump Speed (rpm) |
| $P_{max}$ | Net Maximum System Pressure (psi) |
| Q | Pump Flow Rate (gpm) |

$$P_{av} = \frac{\left(Q \times \frac{P_{actRPM}}{P_{maxRPM}} \times P_{max}\right)}{1{,}714} \times f_m \times f_v$$

$$P_{av} = \left(\frac{\left(72.5 \times \left(\frac{1{,}483}{3{,}050}\right) \times 4{,}600\right)}{1{,}714}\right) \times (0.9 \times 0.9)$$

Pav = 77 hp

Hydraulic Motor Torque (ft-lb) is now calculated using example values for teaching purposes.

$T_m$—Maximum Motor Torque (ft-lbs)

$M_{max}$—Motor Maximum Displacement ($in^3$/rev or cir)

$P_{net}$—Net Maximum System Pressure (psi)

$$T_m = \left(\frac{P_{net} \times M_{max}}{2\pi \times 12}\right) = \left(\frac{4{,}600 \times 4.88}{75.4}\right) = 298 \text{ lb-ft}$$

Circumference at any winding radius is now calculated using example values for teaching purposes. At any wireline layer from the core to the flange circumference is represented by the equation below; the diameter is 54" (flange diameter):

$$L_{circ} = \frac{(\pi D_w)}{12} = \frac{54\pi}{12} = \frac{170}{12}$$

$$L_{circ} = 14.14 \text{ ft}$$

Maximum Tension at Maximum Speed is now calculated using example values for teaching purposes.

$$\text{Maximum Tension} = \text{Motor Torque} \times \left(\frac{\text{Winding Radius (in)}}{12}\right) \times \text{Final Drive Ratio}$$

$$\text{Maximum Tension} = 270 \text{ lb-ft} \times \left(\frac{12}{10.75}\right) \times = 270 \times 0.896 \times 97 = 29{,}235 \text{ lbf}$$

$$\text{Maximum Tension@Maximum Speed} = \frac{(\text{Available } Hyd \text{ hp} \times 33{,}000)}{\text{Max Speed } (fpm)}$$

$$\text{Maximum Tension@Maximum Speed} = \frac{(128 \times 33{,}000)}{290} = 14{,}565 \text{ lbf}$$

Number of Layers on Drum is now calculated using example values for teaching purposes.

$D_b$—Drum Core Diameter (in)

$D_c$—Cable Diameter (in)

$W_f$— Flange Width (in)

$F_d$— Wireline drum flange diameter (inches)

n—Number of wireline layers for any particular wireline and drum size $$n = 1 + \left(\frac{\left(\left(\frac{F_d}{2} - \frac{D_b}{2}\right) - D_c\right)}{(D_c \times 0.866)}\right) =$$

$$1 + \left(\frac{((27 - 10.25) - 0.5)}{(0.5 \times 0.866)}\right) = 1 + \left(\frac{(16.75 - .05)}{0.433}\right) = 1 + 37.53 = 38.5$$

Or:

$$H_f = n * \frac{D_c}{2} * \tan\left(\frac{\pi}{3}\right)$$

$$\frac{1}{n} = \left(\frac{\frac{D_c}{2} * \tan\left(\frac{\pi}{3}\right)}{H_f}\right)$$

-continued $$n = \left(\frac{H_f - D_c}{\frac{D_c}{2} * \tan\left(\frac{\pi}{3}\right)}\right) + 1 = 38.7$$

Drum Capacity is now calculated.

$$\sum_{1}^{Total\ Wraps} \frac{\text{Length}}{\text{Layer}} = \text{Total Cable Length}$$

Total Gear Reduction Ratio is now calculated using example values for teaching purposes.

$$G - \text{Total Gear Reduction Ratio}$$

$$G = Ratio_{gb} \times \left(\frac{\text{Drum } Sprocket_{No.\ Teeth}}{\text{Drive } Sprocket_{No.\ Teeth}}\right) = \left(\frac{23 \times 90}{19}\right)$$

$$G = 109$$

Maximum Speed at Maximum Possible Tension at Core (fpm) is now calculated using example values for teaching purposes.

$L_{s,max_ten}$—Maximum wireline speed at the core $T_{l,max}$—Maximum line pull at the wireline drum core (lbf)

$P_{av}$—Net available power at the drum flange (hp)

$$L_{s,max@core} = \left(\frac{P_{av} * 33{,}000}{T_{l,max}}\right) = \left(\frac{117 * 33{,}000}{37{,}371}\right)$$

$L_{s,max\ @\ core}$=103

Maximum Speed at Maximum Possible Tension at Flange (fpm) is now calculated using example values for teaching purposes.

$L_{s,max_ten@\ flange}$—Maximum wireline speed at the flange at the maximum possible tension $T_{l,max\ @\ flange}$—Maximum line pull at the wireline drum flange (lbf)

$P_{av}$—Net available power at the drum (hp)

$$L_{s,max_ten@flange} = \left(\frac{P_{av} * 33{,}000}{T_{l,max}}\right) = \left(\frac{117 * 33{,}000}{14,\ 187}\right)$$

$L_{s,max_ten@\ flange}$=272 fpm

Maximum Speed at Maximum Tension is now calculated using example values for teaching purposes.

$$\text{Max Line Speed} = \text{Maximum Drum Speed } (rpm) \times \text{Winding Radius} \times 2\pi$$

$$\text{Max Line Speed@Layer 1} = 51.5\ (rpm) \times \left(\frac{10.75}{12}\right) \times 2\pi = 51.5 \times 0.896 \times 2\pi = 290\ fpm$$

$$\text{Maximum Speed@Maximum Tension} = \frac{(\text{Available } Hyd \text{ HP} \times 33{,}000)}{\text{Max Tension}}$$

$$\text{Maximum Speed@Maximum Tension} = \frac{(128 \times 33{,}000)}{29{,}235} = 144\ fpm$$

Maximum Speed at Drum Core (fpm) is now calculated using example values for teaching purposes.

$$L_{s,max} = S_{max}\left(\frac{2\pi \times R_w}{G}\right) = 5{,}000\left(\frac{2\pi \times 0.875}{109}\right)$$

$$L_{s,max} = 252\ fpm$$

Maximum Speed at Drum Flange (fpm) is now calculated using example values for teaching purposes.

$$L_{s,max} = S_{max}\left(\frac{\pi \times R_w}{G}\right) = 5{,}000\left(\frac{2\pi \times 2.25}{109}\right)$$

$$L_{s,max} = 649\ fpm$$

Maximum Line Tension at Drum Core (lbf) is now calculated using example values for teaching purposes.

$T_{l,max\ @\ core}$—Maximum possible line tension @ drum core $T_m$—Maximum hydraulic motor torque (lb-ft)

$$T_{l,max@core} = \frac{G \times T_m}{R_w} = \frac{(109 \times 293)}{\left(\frac{10.25}{12}\right)} = \frac{(109 \times 293 \times 12)}{10.25}$$

$T_{l,max\ @\ core}$=37,371 lbs

Maximum Line Tension at Drum Flange (ft-lb) is now calculated using example values for teaching purposes.

$$T_{l,\max} = \frac{G \times T_m}{R_w} = \frac{(109 \times 293)}{\left(\frac{27}{12}\right)} = \frac{(109 \times 293 \times 12)}{27} = 14{,}187\ \text{lbf}$$

Maximum Tension at Logging Speed is now calculated using example values for teaching purposes.

$$\text{Maximum Tension@Logging Speed} = \frac{(\text{Available } Hyd\ \text{hp} \times 33{,}000)}{\text{Logging Speed}}$$

$$\text{Maximum Tension@Maximum Speed} = \frac{(128 \times 33{,}000)}{100} = 14{,}565\ \text{lbf}$$

Derivation of the Power Equation is now discussed. The overall performance of the winch is determined by the amount of horsepower provided to the drum and not that produced by the diesel engine or the electric motor. A certain percentage of the initial horsepower power is lost depending on the power transmission efficiency. In general, the power loss comes in the form of heat.

Horsepower (hp) is a unit of measurement of power, the rate at which work is done. Note that from the following equations, if the load is not moving, there is NO work being done regardless of the applied load.

$$\text{Power} = \frac{\text{Force} \times \text{Distance}}{\text{Time}} \tag{a}$$

Using the example where a constant tangential force of 10,000 pounds was applied to a 1 ft. winding radius with the drum rotating at 50 rpm, the force involved is known, so to calculate power, the distance the drum rotates per unit time is needed and expressed as:

$$\text{Power} = \frac{10{,}000\ \text{lbs.} \times \text{Distance}}{\text{Minute}} \tag{b}$$

$$\text{Distance} = \text{Distance per Revolution} = 2\pi \times \text{Radius} = 2\pi \times 1\ \text{ft.} = 6.283\ \text{ft.}$$

$$\frac{\text{Distance}}{\text{Minute}} = 2\pi \times \text{Radius} \times rpm$$

$$\frac{\text{Distance}}{\text{Minute}} = 6.283\ \text{ft/revolution} \times 50\ rpm = 314\ \text{feet/minute}$$

From the above, enough is known to calculate the power requires to rotate the with 10,000 lb. line tension at a winding radius of 1 foot at 50 rpm (roughly the maximum rotational speed of most units). This will indicate how much power is required and therefore whether or now the unit is capable of doing this.

$$\text{Power} = \frac{\text{Force} \times \text{Distance}}{\text{Time}} = \left(10{,}000\ \text{lb.} \times 314\frac{\text{ft}}{\text{min}}\right) = \frac{3{,}141{,}544\ \text{ft-lb}}{\text{minute}}$$

Since one horsepower equals 33,000 foot-pounds of work per minute, $$\text{Horsepower} = \frac{\text{Power}\left(\frac{\text{ft-lb}}{\text{min}}\right)}{33{,}000} = \frac{3{,}141{,}544\left(\frac{\text{ft-lb}}{\text{min}}\right)}{33{,}000} = 95\ \text{hp}$$

Similarly:

Torque=Force× Radius

Dividing both sides by the radius results in:

$$\text{Force} = \frac{\text{Torque}}{\text{Radius}} \tag{c}$$

$$\text{Power} = \frac{\text{Force} \times \text{Distance}}{\text{Minute}}$$

So if the equivalent for "Force" from equation (a) and distance per minute from equation (b) are substituted into equation (c), the following result is obtained:

$$\text{Power} = \left(\frac{\text{Torque}}{\text{Radius}}\right) \times (rpm \times \text{Radius} \times 2\pi)$$

$$\frac{\text{Power}}{33{,}000} = \frac{\left(\frac{\text{Torque}}{\text{Radius}}\right) \times (rpm \times \text{Radius} \times 2\pi)}{33{,}000}$$

$$\text{Horsepower} = \frac{\left(\frac{\text{Torque}}{\text{Radius}}\right) \times (rpm \times \text{Radius} \times 6.28)}{33{,}000}$$

By reducing, the following result is obtained:

$$\text{Horsepower} = \frac{\text{Torque} \times rpm \times 6.28}{33{,}000}$$

Since $$\frac{33{,}000}{6.2832} = 5{,}252$$

$$\text{Horsepower} = \frac{\text{Torque} \times rpm \times 6.28}{33{,}000} = \frac{\text{Torque} \times rpm}{5{,}252}$$

$$\text{Horsepower} = \frac{\text{Torque} \times rpm}{5{,}252} = \frac{10{,}000 \times 50}{5{,}252} = 95$$

Note that at 5,252 rpm, torque and horsepower are equal. At any rpm below 5,252, the value of torque is greater than the value of horsepower. Above 5,252 rpm, the value of torque is less than the value of horsepower.

Embodiment 1

A method for operating a wireline winch configured to convey a wireline coupled to a downhole tool disposed in a borehole penetrating the earth, the method comprising: receiving with a processor a first cumulative surface wireline tension limit as a function of depth for downhole wireline components comprising the downhole tool, a cable head weakpoint coupled to the downhole tool, and the wireline up to a specified point along the wireline; inputting into the processor (i) a wireline speed as a function of depth and (ii) surface equipment data related to rig-up equipment comprising a wireline winch, a wireline winch drum, an optional capstan, and the wireline from the specified point to the wireline winch; calculating with the processor a second cumulative surface wireline tension limit as a function of depth using the wireline speed and the surface equipment data; combining the first cumulative surface wireline tension limit as a function of depth with the second cumulative surface wireline tension limit as a function of depth to provide a total cumulative surface wireline tension limit as a function of depth that takes into account downhole wireline components and surface wireline components; presenting with the processor the total cumulative surface wireline tension limit as a function of depth and operating wireline tension values as a function of depth for the downhole tool conveyed through the borehole to a user; performing with the processor an assessment of the operating wireline tension values as a function of depth versus the total cumulative surface wireline tension limit as a function of depth; and operating the wireline winch using the assessment and a winch controller.

Embodiment 2

The method according to any prior embodiment wherein the wireline comprises one or more splices and the second cumulative surface wireline tension limit as a function of depth for the wireline having one or more splices accounts for tension degradation due to each splice and for the wireline being reeled on the wireline winch drum such that when each splice is reeled in on the wireline winch drum, the second cumulative surface wireline tension limit as a function of depth is not degraded for that reeled in splice.

Embodiment 3

The method according to any prior embodiment wherein the cumulative wireline tension limit is reduced a selected percentage of an undamaged wireline tension limit for each splice.

Embodiment 4

The method according to any prior embodiment wherein the first cumulative surface wireline tension limit as a function of depth accounts for geometry and trajectory of the borehole, dimensions and weight of the downhole tool, properties of a borehole fluid, friction between the downhole tool and a wall of the borehole, and resistance to movement of the downhole tool by the borehole fluid.

Embodiment 5

The method according to any prior embodiment wherein the rig-up equipment further comprises a floor chain, a floor sheave coupled to the floor chain, a T-bar, a derrick sheave and a load cell coupled to the derrick sheave.

Embodiment 6

The method according to any prior embodiment wherein the surface equipment data comprises a maximum operating load for each component of the rig-up equipment and the wireline from the specified point to the wireline winch.

Embodiment 7

The method according to any prior embodiment wherein calculating a second cumulative surface wireline tension limit as a function of depth comprises calculating a surface wireline tension limit due to the wireline being wound on the wireline winch drum at the wireline speed.

Embodiment 8

The method according to any prior embodiment wherein calculating a second cumulative surface wireline tension limit as a function of depth comprises determining a distribution of wireline tensions due to the optional capstan.

Embodiment 9

The method according to any prior embodiment wherein combining comprises using a most limiting surface wireline tension for each borehole depth or range of borehole depths from each of the surface tension limits determined for the downhole components and the surface wireline components.

Embodiment 10

The method according any prior embodiment wherein presenting comprises providing curves illustrating the total cumulative surface wireline tension limit as a function of depth and the operating wireline tension values as a function of depth.

Embodiment 11

The method according to any prior embodiment wherein performing an assessment of the operating wireline tension values as a function of depth versus the total cumulative surface wireline tension limit as a function of depth comprises: calculating a difference between the operating wireline tension values as a function of depth and the total cumulative surface wireline tension limit as a function of depth for each depth or range of depths; and determining if the difference is at, above or below a threshold value.

Embodiment 12

The method according to any prior embodiment wherein the threshold value includes a first threshold value, a second threshold value less than the first threshold value, and a third threshold value less than the second threshold value such that (i) operation of the wireline winch with the difference at or above the first threshold value signifies "the result falls within a desired range," (ii) operation of the wireline winch with the difference between the first threshold value and the second threshold value signifies "the result is marginal or calls for special attention," and (iii) operation of the wireline winch with the difference less than the third threshold value signifies "the result indicates conditions that will probably prevent the wireline job from being completed."

Embodiment 13

The method according to any prior embodiment wherein the assessment comprises one or more statements comprising the difference for each depth or range of depths.

Embodiment 14

The method according to any prior embodiment wherein the downhole tool is a free tool.

Embodiment 15

The method according to any prior embodiment wherein the downhole tool is a stuck tool.

Embodiment 16

A system for operating a wireline winch configured to convey a wireline coupled to a downhole tool disposed in a borehole penetrating the earth, the system comprising: downhole wireline components comprising the downhole tool, a cable head weakpoint coupled to the downhole tool, and the wireline up to a specified point along the wireline; rig-up equipment comprising a wireline winch, a wireline winch drum, an optional capstan, and the wireline from the specified point to the wireline winch; and a processor configured to: receive a first cumulative surface wireline tension limit as a function of depth for downhole wireline components comprising the downhole tool, a cable head weakpoint coupled to the downhole tool, and the wireline up to a specified point along the wireline; receive (i) a wireline speed as a function of depth and (ii) surface equipment data related to rig-up equipment comprising a wireline winch, a wireline winch drum, an optional capstan, and the wireline from the specified point to the wireline winch; calculate a second cumulative surface wireline tension limit as a function of depth using the wireline speed and the surface equipment data; combine the first cumulative surface wireline tension limit as a function of depth with the second cumulative surface wireline tension limit as a function of depth to provide a total cumulative surface wireline tension limit as a function of depth that takes into account downhole wireline components and surface wireline components; present the total cumulative surface wireline tension limit as a function of depth and operating wireline tension values as a function of depth for the downhole tool conveyed through the borehole to a user; perform an assessment of the operating wireline tension values as a function of depth versus the total cumulative surface wireline tension limit as a function of depth; a winch controller configured to control the wireline winch by an operator using the assessment.

Embodiment 17

The system according to any prior embodiment wherein the wireline comprises one or more splices and the second cumulative surface wireline tension limit as a function of depth for the wireline having one or more splices accounts for the wireline being reeled on the wireline winch drum such that when each splice is reeled in on the wireline winch drum, the second cumulative surface wireline tension limit as a function of depth is not degraded for that reeled in splice.

Embodiment 18

The system according to any prior embodiment wherein the rig-up equipment further comprises a floor chain, a floor sheave coupled to the floor chain, a T-bar, a derrick sheave and a load cell coupled to the derrick sheave.

Embodiment 19

The system according to any prior embodiment wherein calculate a second cumulative surface wireline tension limit as a function of depth comprises calculate a surface wireline tension limit due to the wireline being wound on the wireline winch drum at the wireline speed.

Embodiment 20

The system according to any prior embodiment wherein combine comprises use a most limiting surface wireline tension for each borehole depth or range of borehole depths from each of the surface tension limits determined for the downhole components and the rig-up equipment.

Embodiment 21

The system according to any prior embodiment wherein perform an assessment of the operating wireline tension values as a function of depth versus the total cumulative surface wireline tension limit as a function of depth comprises: calculate a difference between the operating wireline tension values as a function of depth and the total cumulative surface wireline tension limit as a function of depth for each depth or range of depths; and determine if the difference is at, above or below a threshold value.

Embodiment 22

The system according to any prior embodiment wherein the threshold value includes a first threshold value, a second threshold value less than the first threshold value, and a third threshold value less than the second threshold value such that (i) operation of the wireline winch with the difference at or above the first threshold value signifies "the result falls within a desired range," (ii) operation of the wireline winch with the difference between the first threshold value and the second threshold value signifies "the result is marginal or calls for special attention," and (iii) operation of the wireline winch with the difference less than the third threshold value signifies "the result indicates conditions that will probably prevent the wireline job from being completed."

In support of the teachings herein, various analysis components may be used, including a digital and/or an analog system. For example, the surface receiver or computer processing system 7, the control system 13 and/or the load cell 35 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" when used together do not denote a particular order, but are used to distinguish different elements.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for designing and implementing a wireline operation to convey a wireline coupled to a downhole tool disposed in a borehole penetrating the earth, the method comprising:

receiving with a processor surface wireline tension values and a first cumulative surface wireline tension limit as a function of depth for an initial selection of operating conditions comprising wireline speed and direction and downhole wireline components comprising the downhole tool, a cable head weakpoint coupled to the downhole tool, and the wireline up to a specified point along the wireline;

inputting into the processor (i) a target wireline speed as a function of depth and (ii) surface equipment data related to an initial selection of rig-up equipment comprising a wireline winch, a wireline winch drum, an optional capstan, and the wireline from the specified point to the wireline winch;

calculating with the processor a second cumulative surface wireline tension limit as a function of depth using the wireline speed and the surface equipment data;

combining the first cumulative surface wireline tension limit as a function of depth with the second cumulative surface wireline tension limit as a function of depth to provide a total cumulative surface wireline tension limit as a function of depth that takes into account the downhole wireline components and surface wireline components selected;

presenting with the processor the total cumulative surface wireline tension limit as a function of depth and the surface wireline tension values as a function of depth for the downhole tool conveyed through the borehole to a user;

performing with the processor an assessment of the surface wireline tension values as a function of depth versus the total cumulative surface wireline tension limit as a function of depth; and presenting with the processor a list of one or more violations of the cumulative surface wireline tension limit along with the operating conditions and the surface and/or downhole wireline components that caused the one or more violations to a user; and physically correcting the one or more violations by changing equipment or operating the winch at a wireline speed that is different from the target speed.

2. The method according to claim 1, wherein the wireline comprises one or more splices and the second cumulative surface wireline tension limit as a function of depth for the wireline having one or more splices accounts for tension degradation due to each splice and for the wireline being reeled on the wireline winch drum such that when each splice is reeled in on the wireline winch drum, the second cumulative surface wireline tension limit as a function of depth is not degraded for that reeled in splice.

3. The method according to claim 2, wherein the cumulative wireline tension limit is reduced a selected percentage of an undamaged wireline tension limit for each splice.

4. The method according to claim 1, wherein the first cumulative surface wireline tension limit as a function of depth accounts for geometry and trajectory of the borehole, dimensions and weight of the downhole tool, properties of a borehole fluid, friction between the downhole tool and a wall of the borehole, and resistance to movement of the downhole tool by the borehole fluid.

5. The method according to claim 1, wherein the rig-up equipment further comprises a floor chain, a floor sheave coupled to the floor chain, a T-bar, a derrick sheave and a load cell coupled to the derrick sheave.

6. The method according to claim 1, wherein the surface equipment data comprises a maximum operating load for each component of the rig-up equipment and the wireline from the specified point to the wireline winch.

7. The method according to claim 1, wherein calculating a second cumulative surface wireline tension limit as a function of depth comprises calculating a surface wireline tension limit due to the wireline being wound on the wireline winch drum at the wireline speed.

8. The method according to claim 1, wherein calculating a second cumulative surface wireline tension limit as a function of depth comprises determining a distribution of wireline tensions due to the optional capstan.

9. The method according to claim 1, wherein combining comprises using a most limiting surface wireline tension for each borehole depth or range of borehole depths from each of the surface tension limits determined for the downhole components and the surface wireline components.

10. The method according to claim 1, wherein presenting comprises providing curves illustrating the total cumulative surface wireline tension limit as a function of depth and the operating wireline tension values as a function of depth.

11. The method according to claim 1, wherein performing an assessment of the operating wireline tension values as a function of depth versus the total cumulative surface wireline tension limit as a function of depth comprises:

calculating a difference between the operating wireline tension values as a function of depth and the total cumulative surface wireline tension limit as a function of depth for each depth or range of depths; and determining if the difference is at, above or below a threshold value.

12. The method according to claim 11, wherein the threshold value includes a first threshold value, a second threshold value less than the first threshold value, and a third threshold value less than the second threshold value such that (i) operation of the wireline winch with the difference at or above the first threshold value signifies "the result falls within a desired range," (ii) operation of the wireline winch with the difference between the first threshold value and the second threshold value signifies "the result is marginal or calls for special attention," and (iii) operation of the wireline winch with the difference less than the third threshold value signifies "the result indicates conditions that will probably prevent the wireline job from being completed".

13. The method according to claim 11, wherein the assessment comprises one or more statements comprising the difference for each depth or range of depths.

14. The method according to claim 1, wherein the downhole tool is a free tool.

15. The method according to claim 1, wherein the downhole tool is a stuck tool.

16. A system for designing and implementing a wireline operation to convey a wireline, the system comprising:

downhole wireline components comprising the downhole tool, a cable head weakpoint coupled to the downhole tool, and the wireline up to a specified point along the wireline;

rig-up equipment comprising a wireline winch, a wireline winch drum, an optional capstan, and the wireline from the specified point to the wireline winch; and a processor configured to:

receive surface wireline tension values and a first cumulative surface wireline tension limit as a function of depth for an initial selection of operating conditions comprising wireline speed and direction and downhole wireline components comprising the downhole tool, a cable head weakpoint coupled to the downhole tool, and the wireline up to a specified point along the wireline;

receive (i) a target wireline speed as a function of depth and (ii) surface equipment data related to an initial selection of rig-up equipment comprising a wireline winch, a wireline winch drum, an optional capstan, and the wireline from the specified point to the wireline winch;

calculate a second cumulative surface wireline tension limit as a function of depth using the wireline speed and the surface equipment data;

combine the first cumulative surface wireline tension limit as a function of depth with the second cumulative surface wireline tension limit as a function of depth to provide a total cumulative surface wireline tension limit as a function of depth that takes into account the downhole wireline components and surface wireline components selected;

present the total cumulative surface wireline tension limit as a function of depth and the surface wireline tension values as a function of depth for the downhole tool conveyed through the borehole to a user;

perform an assessment of the surface wireline tension values as a function of depth versus the total cumulative surface wireline tension limit as a function of depth; and present a list of one or more violations of the cumulative surface wireline tension limit along with the operating conditions and the surface and/or downhole wireline components that caused the one or more violations to a user;

a winch controller configured to control the wireline winch to operate at the target speed and a different speed as needed to correct the one or more violations; and replacement equipment as needed to change one or more components of the downhole wireline components and the rig-up equipment to correct the one or more violations.

17. The system according to claim 16, wherein the wireline comprises one or more splices and the second cumulative surface wireline tension limit as a function of depth for the wireline having one or more splices accounts for the wireline being reeled on the wireline winch drum such that when each splice is reeled in on the wireline winch drum, the second cumulative surface wireline tension limit as a function of depth is not degraded for that reeled in splice.

18. The system according to claim 16, wherein the rig-up equipment further comprises a floor chain, a floor sheave coupled to the floor chain, a T-bar, a derrick sheave and a load cell coupled to the derrick sheave.

19. The system according to claim 16, wherein calculate a second cumulative surface wireline tension limit as a function of depth comprises calculate a surface wireline tension limit due to the wireline being wound on the wireline winch drum at the wireline speed.

20. The system according to claim 16, wherein combine comprises use a most limiting surface wireline tension for each borehole depth or range of borehole depths from each of the surface tension limits determined for the downhole components and the rig-up equipment.

21. The system according to claim 16, wherein perform an assessment of the operating wireline tension values as a function of depth versus the total cumulative surface wireline tension limit as a function of depth comprises:

calculate a difference between the operating wireline tension values as a function of depth and the total cumulative surface wireline tension limit as a function of depth for each depth or range of depths; and determine if the difference is at, above or below a threshold value.

22. The system according to claim 16, wherein the threshold value includes a first threshold value, a second threshold value less than the first threshold value, and a third threshold value less than the second threshold value such that (i) operation of the wireline winch with the difference at or above the first threshold value signifies "the result falls within a desired range," (ii) operation of the wireline winch with the difference between the first threshold value and the second threshold value signifies "the result is marginal or calls for special attention," and (iii) operation of the wireline winch with the difference less than the third threshold value signifies "the result indicates conditions that will probably prevent the wireline job from being completed".

23. The method according to claim 1, further comprising iterating the receiving, inputting, calculating, combining, presenting, and performing in order to optimize a wireline operation to eliminate the one or more violations.

24. The method according to claim 23, further comprising calculating surface wireline tension values for each iteration and operating the wireline winch using a winch controller based on final calculated surface wireline tension values as a function of depth and the total cumulative surface wireline tension limit as a function of depth.

25. The method according to claim 24, wherein the winch is operated manually.

26. The method according to claim 24, wherein the winch is operated automatically by the winch controller.

* * * * *